US008491404B2

(12) United States Patent
Kim

(10) Patent No.: US 8,491,404 B2
(45) Date of Patent: Jul. 23, 2013

(54) GOLF PRACTICE BAT HAVING ADDITIONAL BUILT-IN WEIGHT FOR ADJUSTING TOP, IMPACT AND FINISH TIMING

(75) Inventor: Hae Seong Kim, Daejeon (KR)

(73) Assignee: Bescon Co., Ltd., Chuncheongbuk-Do (KR)

( * ) Notice: Subject to any disclaimer, the term of this patent is extended or adjusted under 35 U.S.C. 154(b) by 0 days.

(21) Appl. No.: 13/522,362

(22) PCT Filed: Nov. 26, 2010

(86) PCT No.: PCT/KR2010/008438

§ 371 (c)(1),
(2), (4) Date: Jul. 16, 2012

(87) PCT Pub. No.: WO2011/090263

PCT Pub. Date: Jul. 28, 2011

(65) Prior Publication Data

US 2012/0289353 A1 Nov. 15, 2012

(30) Foreign Application Priority Data

Jan. 19, 2010 (KR) ..... 10-2010-0004608

(51) Int. Cl.
*A63B 69/36* (2006.01)

(52) U.S. Cl.
USPC ..... 473/219; 473/234

(58) Field of Classification Search
USPC ..... 473/219, 226, 231–234, 256, 257, 473/451, 457
See application file for complete search history.

(56) References Cited

U.S. PATENT DOCUMENTS

| | | | | |
|---|---|---|---|---|
| 3,254,895 | A * | 6/1966 | Haas | 473/234 |
| 3,575,419 | A * | 4/1971 | Davis | 473/234 |
| 4,222,562 | A * | 9/1980 | Gardner | 273/129 K |
| 4,283,057 | A * | 8/1981 | Ragan | 473/234 |
| 4,614,343 | A | 9/1986 | Radway | |
| 4,953,868 | A * | 9/1990 | Thompson et al. | 473/234 |
| 6,805,005 | B1 * | 10/2004 | Elizondo | 73/488 |
| 7,001,283 | B2 * | 2/2006 | Jeong | 473/219 |
| 2005/0192112 | A1 | 9/2005 | Kim | |
| 2006/0058108 | A1 | 3/2006 | Kim | |

FOREIGN PATENT DOCUMENTS

| | | |
|---|---|---|
| JP | 06-031774 | 4/1994 |
| KR | 1998-042286 | 9/1998 |
| KR | 20-2009-0010707 | 10/2009 |

* cited by examiner

*Primary Examiner* — Nini Legesse
(74) *Attorney, Agent, or Firm* — IPLA P.A.; James E. Bame

(57) ABSTRACT

A golf practice bat is provided for practicing golf swings such as driver shots, iron shots, and the like. The location and timing at a top position during a back-swing, timing at the point of impact, and location and timing of the finish in a follow-through swing, are indicated through an impact sound so that a user can practice swings while estimating the positions of a club head and the timing from a backswing to impact and through to the finish of the follow-through swing. Further, a metal weight is integrated inside the golf practice bat such that loads are not distributed to the head portion, but are concentrated on a lower portion during golf swing practice. Therefore, a fixed weight is formed such that muscular strength is increased and a swing trajectory is naturally created during a golf swing.

10 Claims, 7 Drawing Sheets

GOLF PRACTICE BAT HAVING ADDITIONAL BUILT-IN WEIGHT FOR ADJUSTING TOP, IMPACT AND FINISH TIMING

BACKGROUND OF THE INVENTION

The present invention relates to a golf practice bat adapted to notify the user of the position and timing at the top during a back swing, the timing at the time of impact, and the position and timing at the time of finish during a follow swing by means of collision sounds, respectively, during golf swing practices (e.g. driver shots, iron shots) so that the user can estimate the position and timing of the club head during swing practices throughout the back swing, the impact, and the time of finish of the follow swing, and more particularly, to a golf practice bat for adjusting top, impact, and finish timing, including a shaft of a stick shape having a diameter determined to be grasped by hand; a head portion of a pillar shape having a diameter larger than the shaft, the head portion being integrally formed on a lower end of the shaft; a weight made of a metal material and integrally contained on an inner lower portion of the head portion so that, while forming a predetermined weight feeling, a load is concentrated on a lower portion of the head portion; a first notice tube contained and installed in a upright position on an inner intermediate portion of the head portion, the first notice tube having a top metal plate fixedly installed on an inner upper portion, a buffer material fixedly installed on a lower portion, and a first notice ball movably contained inside the first notice tube so that, when the head portion is turned upside down and reaches top and finish positions during back and follow swings, the first notice ball comes down to the top metal plate and generates collision sounds enabling estimation of positions and timing of top and finish; and a second notice tube contained and installed in a upright position on the inner intermediate portion of the head portion together with the first notice tube, the second notice tube having a magnet plate fixedly installed on an inner upper portion, a bottom metal plate fixedly installed on a lower portion, and a second notice ball movably contained inside the second notice tube so that the second notice ball abuts and attaches to the magnet plate in a top position and, when a predetermined rotational force is applied at a time of impact during a down swing, the second notice ball escapes from the magnet plate, reaches the bottom metal plate, and generates a collision sound enabling estimation of impact timing.

In general, golf is a game in which clubs (e.g. drivers, irons, putters) are used to hit a ball into hole cups positioned at predetermined distances, and is played by many people who enjoy its unique pleasure and also find it as a good exercise. In order to derive more pleasure from it and to play a higher level of games, correct hitting with clubs is crucial, which is based on learning of correct swing postures.

The most important factors of such correct golf swing postures include the method of correctly grasping clubs by both hands, maintenance of the accurate square angle during an impact so that the club face is perpendicular to the ball, and adjustment of impact timing, at which the club face hits the ball, for the hardest, fastest, and most powerful hitting. In the case of a driver shot, which is aimed at sending the ball to the farthest location, the maintenance of the accurate square angle of the club face, as well as the impact timing, becomes more significant. During golf swing practices, such as the driver shots, the player exhibits various types of swing postures, which are results of swing habits acquired by himself/herself, and it is very difficult to correct such postures. When a conventional golf club is used to practice swings, the club is too light to strengthen muscles, and the player has no way of confirming whether the swing is correct or not. As a result, it is impossible to correct swing postures to obtain accurate and smooth swings.

In order to solve the above-mentioned problems, the present applicant has filed Korean Laid-Open Utility Model No. 20-2009-0010707, which discloses a golf practice bat 1' for adjusting impact timing, as shown in FIG. 7. The golf practice bat 1' includes a shaft 2' having the shape of a stick of the same diameter and having an escapement prevention engaging ledge 22' formed on its upper end; and a head portion 3' integrally formed on the lower end of the shaft 2', the head portion 3' having a tapered portion 11' formed on its upper portion so that the diameter gradually increases from the lower end of the shaft 2' to the lower side, the lower portion of the head portion 3' having the shape of a cylinder of a diameter larger than that of the shaft 2' so that the load is concentrated. A number of through-holes 12' are formed on the lower portion of the head portion 3' in the horizontal direction at a predetermined upward/downward interval. The entrance portion of each through-hole 12', which is formed near the front surface of the head portion 3', has a large diameter, and the exit portion of each through-hole 12', which is formed near the rear surface of the head portion 3', has a diameter smaller than that of the entrance portion. The diameter and length of the head portion 3' of the golf practice bat 1' are increased so that the load is concentrated on the lower portion, and a constant weight feeling is formed, in order to strengthen muscles in the course of golf swings and establish natural swing trajectories. When the golf practice bat 1' is swung hardest and fastest at the time of impact during a down swing, the airflow introduced through the large entrance portions of the through-holes 12' generates flute sounds as it is discharged through the narrow exit portions, so that the user can notice whether the correct square angle of the club face is maintained or not and whether the impact timing is correct or not during the swing practice. However, the golf practice bat 1' has the following problem: the head portion 3', the diameter and length of which have been increased excessively so that the load is concentrated on the head portion 3', has a very large overall volume, making it inconvenient to carry and store. Furthermore, the load is not concentrated only on the lower end of the golf practice bat 1', but is distributed over the entire head portion 3', making it difficult to form a correct swing trajectory during a golf swing.

In addition, when the golf practice bat 1' is used by a female or elderly player, the weak force and speed of swing generate no flute sound from the through-holes 12', making it difficult to notice the impact timing. Furthermore, the user cannot estimate, during golf swing practices, the top position during a back swing, the timing to start a down swing in the top position, and the position and timing of finish during a follow swing.

SUMMARY OF THE INVENTION

Therefore, the present invention has been made in view of the above-mentioned problems, and an aspect of the present invention is to provide a golf practice bat having the following construction: during a golf swing practice, the load is not distributed over the entire head portion, but is concentrated on the lower portion, and the head portion has a diameter and a length smaller than in the case of the prior art and integrally contains a weight made of a metal material so that the golf practice bat can be carried, stored, and transported very conveniently, a constant weight feeling is formed, muscles are strengthened in the course of golf swings, and a natural swing trajectory is formed; first and second notice tubes are contained and installed on an inner middle portion of the head portion, a first notice ball is contained in the first notice tube and is adapted to move and generate collision sounds enabling estimation of the timing and position at the top and finish time during back and follow swings, and a second notice ball is contained in the second notice tube and is adapted to move and generate collision sounds enabling estimation of impact timing, so that the user can estimate each position and timing during swing practices throughout the top of a back swing, the impact, and the finish time of a follow swing.

In accordance with an aspect of the present invention, there is provided a golf practice bat for adjusting top, impact, and finish timing, including a shaft of a stick shape having a diameter determined to be grasped by hand; a head portion of a pillar shape having a diameter larger than the shaft, the head portion being integrally formed on a lower end of the shaft; a weight made of a metal material and integrally contained on an inner lower portion of the head portion so that, while forming a predetermined weight feeling, a load is concentrated on a lower portion of the head portion; a first notice tube contained and installed in a upright position on an inner intermediate portion of the head portion, the first notice tube having a top metal plate fixedly installed on an inner upper portion, a buffer material fixedly installed on a lower portion, and a first notice ball movably contained inside the first notice tube so that, when the head portion is turned upside down and reaches top and finish positions during back and follow swings, the first notice ball comes down to the top metal plate and generates collision sounds enabling estimation of positions and timing of top and finish; and a second notice tube contained and installed in a upright position on the inner intermediate portion of the head portion together with the first notice tube, the second notice tube having a magnet plate fixedly installed on an inner upper portion, a bottom metal plate fixedly installed on a lower portion, and a second notice ball movably contained inside the second notice tube so that the second notice ball abuts and attaches to the magnet plate in a top position and, when a predetermined rotational force is applied at a time of impact during a down swing, the second notice ball escapes from the magnet plate, reaches the bottom metal plate, and generates a collision sound enabling estimation of impact timing.

The golf practice bat according to the present invention has the following advantages: the head portion integrally contains a weight made of a metal material so that, during a golf swing practice, the load is not distributed over the entire head portion, but is concentrated on the lower portion, the golf practice bat can be carried, stored, and transported very conveniently, a constant weight feeling is formed, muscles are strengthened in the course of golf swings, and a natural swing trajectory is formed; first and second notice tubes are contained and installed on an inner middle portion of the head portion, a first notice ball is contained in the first notice tube and is adapted to move and generate collision sounds enabling estimation of the timing and position at the top and finish time during back and follow swings, and a second notice ball is contained in the second notice tube and is adapted to move and generate collision sounds enabling estimation of impact timing, so that the user can estimate each position and timing during swing practices throughout the top of a back swing, the impact, and the finish time of a follow swing.

DESCRIPTION OF REFERENCE NUMERALS OF MAJOR PORTIONS IN THE DRAWINGS

Figure 1:
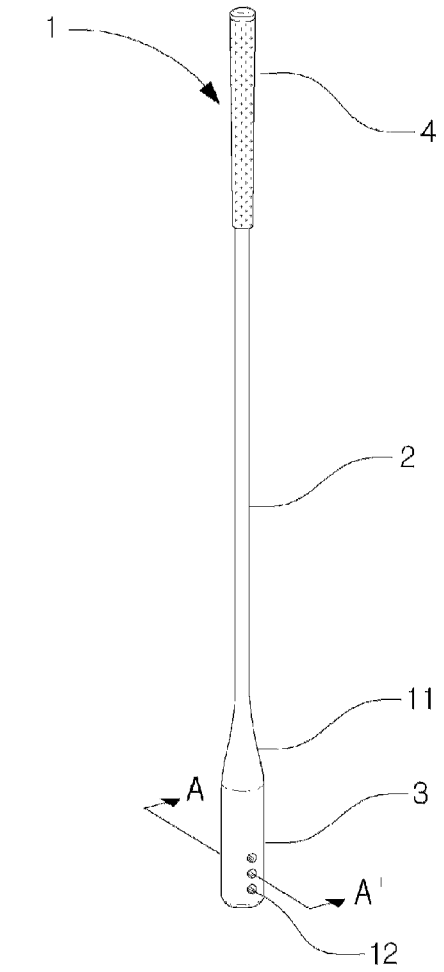
FIG. 1 is a schematic perspective view of a golf practice bat according to the present invention.

1, 1': golf practice bat
2, 2': shaft
3, 3': head portion
4: grasping grip
5: weight
6: protrusion
7: insertion hole
8: concave portion
9: fixing pin
10: plug
11, 11': tapered portion
12, 12': through-hole
13: first notice tube
14: top metal plate
15: buffer material
16: first notice ball
17: second notice tube
18: magnet plate
19: bottom metal plate
20: second notice ball
21*a*, 21*b*, 21*c*, 21*d*: finish caps
22': engaging ledge

DETAILED DESCRIPTION OF THE INVENTION

Hereinafter, a preferred construction according to the present invention will be described in detail with reference to the accompanying drawings.

A golf practice bat 1 according to the present invention is, as shown in FIG. 1-6, adapted to notify the user of the position and timing at the top during a back swing, the timing at the time of impact, and the position and timing at the time of finish during a follow swing by means of collision sounds, respectively, during golf swing practices (e.g. driver shots, iron shots) so that the user can estimate each position and timing during swing practices throughout the back swing, the impact, and the time of finish of the follow swing, muscles are strengthened in the course of golf swings, and a natural swing trajectory is formed. The golf practice bat 1 includes a shaft having the shape of a long stick and having an upper end portion adapted to be grasped by the user with hands; a head portion 3 integrally formed on the lower end of the shaft 2, the head portion 3 having the shape of a pillar with a diameter larger than that of the shaft 2, so that the load is concentrated on the head portion 3; a weight 5 made of a metal material, integrally contained on the inner lower portion of the head portion 3, and adapted to form a constant weight feeling so that the load is concentrated on the lower portion of the head portion 3; a first notice tube 13 contained/installed on the inner middle portion of the head portion 3 in an upright position, the first notice tube 13 containing a first notice ball 16 to enable estimation of the position and timing of the top and finish during back and follow swings, respectively; and a second notice tube 17 contained/installed on the inner middle portion of the head portion 3 in an upright position together with the first notice tube 13, the second notice tube 17 having a second notice ball 20 to enable estimation of impact timing.

The shaft 2, as shown in FIGS. 1-6, is made of a wooden material, and has the shape of a long stick with a predetermined diameter. The diameter of the shaft 2 is determined so that the user can easily grasp it with both hands as in the case of a conventional golf club. The length of the shaft 2 corresponds to about 7/10 to 9/10 of the entire length of the golf practice bat 1. The shaft 2 has a grasping grip 4 made of a material having strong frictional force (e.g. rubber) and fitted/coupled to the upper end of the shaft 2 so that, when the user grasps the grasping grip 4 with both hands and practices swings, the golf practice bat 1 is grasped stably without escaping from the hands.

The head portion 3, as shown in FIGS. 1-6, is made of a wooden material and is adapted so that the load of the golf practice bat 1 is not distributed, but is concentrated on the lower portion, a constant weight feeling is formed, muscles are strengthened in the course of golf swings, and a natural swing trajectory is formed. The head portion 3 is integrally formed on the lower end of the shaft 2, and has the shape of a pillar with a diameter larger than that of the shaft 2, so that the load is concentrated. The length of the head portion 3 corresponds to about 1/10 to 3/10 of the entire length of the golf practice bat 1, and the diameter of the head portion 3 is about 1.5 to 2 times larger than that of the shaft 2. As such, the diameter and length of the head portion 3 are smaller than in the case of the conventional golf practice bat 1'. The head portion 3 has a weight 5 made of a metal material and integrally contained on its inner lower portion so that a constant weight feeling is formed, the load is concentrated on the lower portion of the head portion 3, muscles are strengthened in the course of golf swings, and a natural swing trajectory is formed.

The weight 5 is made of a metal material, and has the shape of a cylinder. The weight 5 has a protrusion 6 integrally formed on its upper or middle portion to be convex outwards so that, even when the golf practice bar 1 is swung hard, the weight 5 does not escape from the inner lower portion of the head portion 3 to the outside. A process of integrally containing/installing the weight 5, which is made of a metal material, and which has the above-mentioned protrusion 6 formed thereon, on the inner lower portion of the head portion 3 will be described with reference to FIG. 3. The lower end of the head portion 3, which is made of a wooden material, for example, is bored up to a predetermined depth using a conventional drill machine, for example, to form a long straight insertion hole 7 on the inner lower portion of the head portion 3. A first notice tube 13 and a second notice tube 17 are inserted/interposed into the inner upper portion of the insertion hole 7. The upper or middle portion of the insertion hole 7, which is positioned below the first notice tube 13 and the second notice tube 17, is partially removed using a drill machine, for example, to form a concave portion 8 having a diameter larger than that of the insertion hole 7. The insertion hole 7 and the concave portion 8 are filled with melted metal (e.g. melted lead), and the metal is solidified so that a weight 5, which has a protrusion 6 formed on its upper or middle portion to be convex outwards, is integrally contained/installed on the inner lower portion of the head portion 3. As a result, a constant load is concentrated on the lower portion of the head portion 3, and the protrusion 6 prevents the contained weight 5 from escaping to the outside even during swings.

Figure 2:
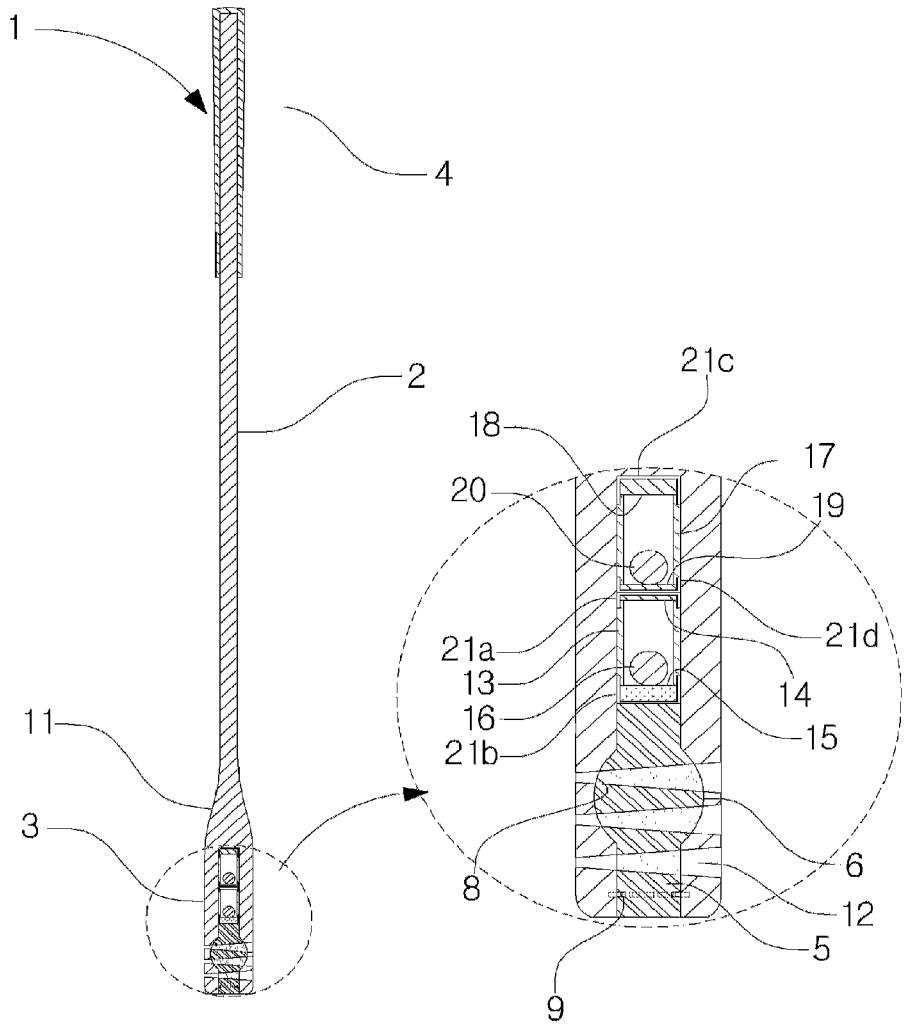
FIG. 2 is a schematic sectional view taken along line A-A' of FIG. 1.
Figure 3:
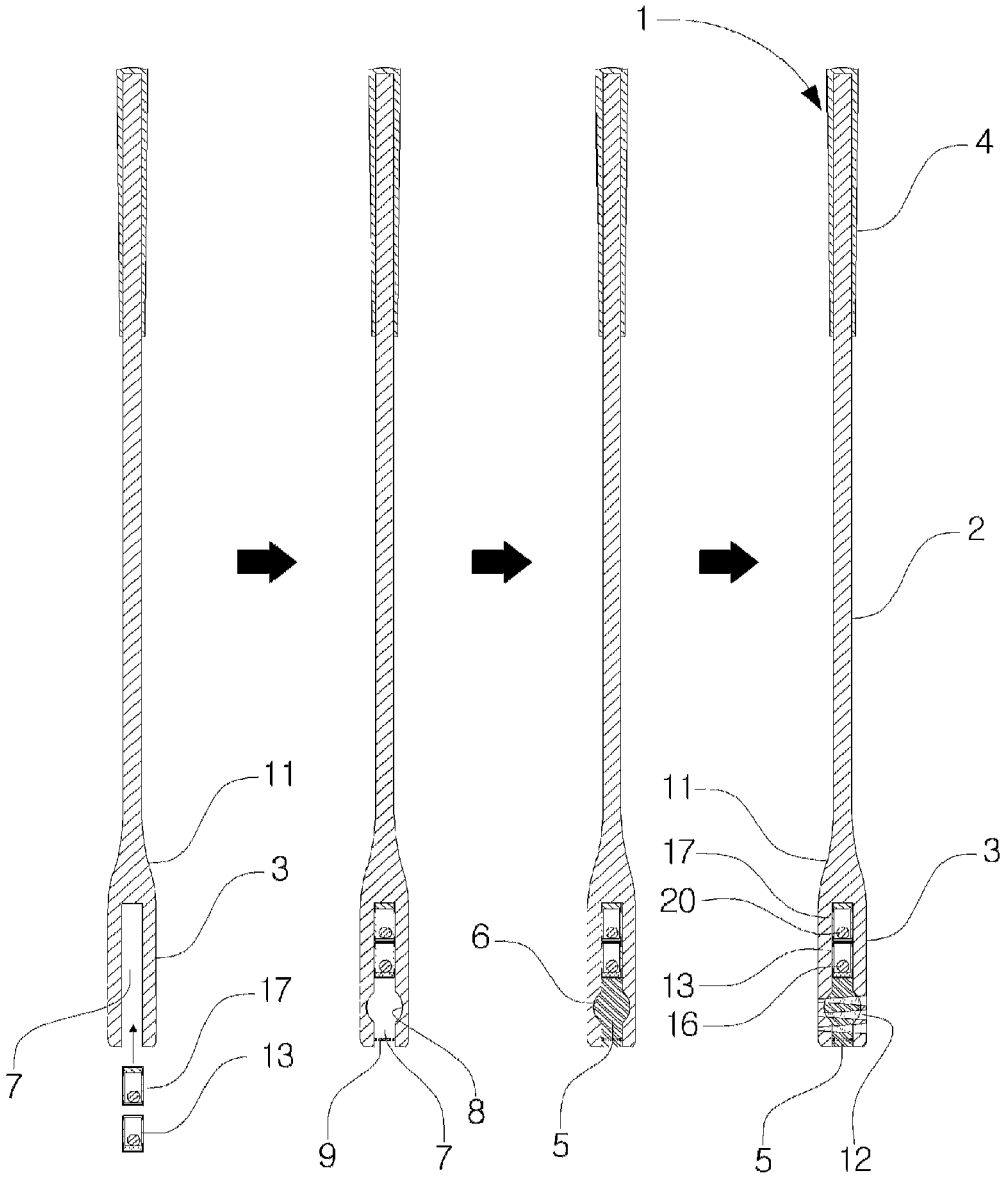
FIG. 3 is a schematic sectional view illustrating a process of containing/installing first and second notice tubes on an inner middle portion of a head portion of a golf practice bat according to the present invention, containing/installing a weight on the lower portion, and boring through-holes.

The insertion hole 7 has a number of fixing pins 9 fixedly installed on its lower inner peripheral surface at a predetermined interval, as shown in FIGS. 2 and 3. Each fixing pin 9 has a portion protruding towards the inside of the insertion hole 7 so that, when the inner lower portion of the insertion hole 7 is filled with melted metal (e.g. lead), the portion of each fixing pin 9, which protrudes towards the inside of the insertion hole 7, remains integrally inserted into the melted metal and is integrated with the weight 5, which is formed through solidification of the melted metal, thereby guaranteeing that the weight 5 remains fixed inside the insertion hole 7 more firmly.

Figure 5:
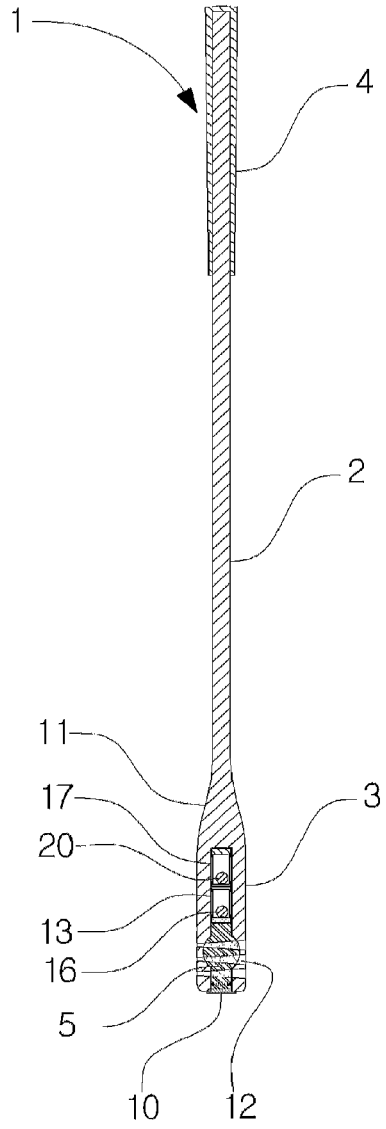
FIG. 5 is a schematic sectional view of a golf practice bat according to another embodiment of the present invention.

According to another embodiment of the present invention, the head portion 3 can be adapted to additionally prevent the contained weight 5 from playing and escaping, as shown in FIG. 5, by filling the inner lower portion of the insertion hole 7 with melted metal (e.g. lead), solidifying the metal, and fixing/attaching a plug 10 to the entrance portion of the insertion hole 7 using a conventional adhesive, for example.

The head portion 3 has a tapered portion 11 formed so that its upper portion, which is integrally formed on the lower end of the shaft 2, has a diameter gradually increasing towards the lower side. As a result, the shaft 2 and the head portion 3 are connected naturally. The head portion 3 contains a weight 5 so that it is preferably about 1.5-3 times heavier than the shaft 2. If the head portion 3 is lighter than the above range, there is no constant weight feeling formed, making swing practices ineffective. If the head portion 3 is heavier than the above range, on the other hand, the excessively heavy head portion 3 makes it difficult to form a proper swing trajectory during swing practices.

Figure 6:
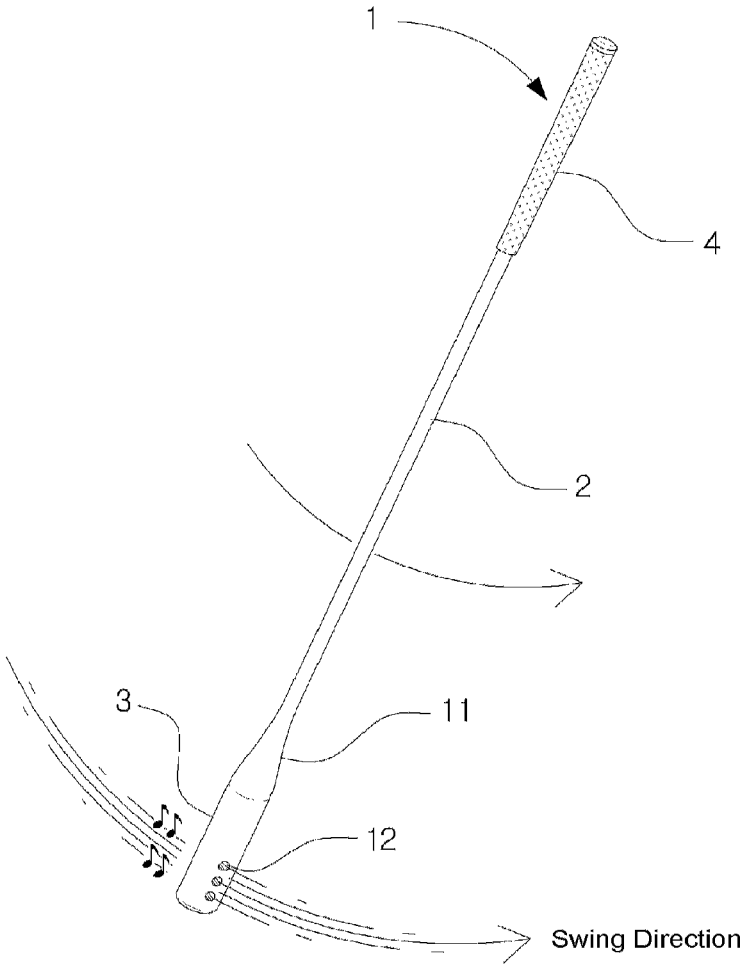
FIG. 6 is a schematic perspective view illustrating generation of flute sounds when an airflow is formed via through-holes at the time of impact during a swing practice using a golf practice bat according to the present invention.
Figure 7:
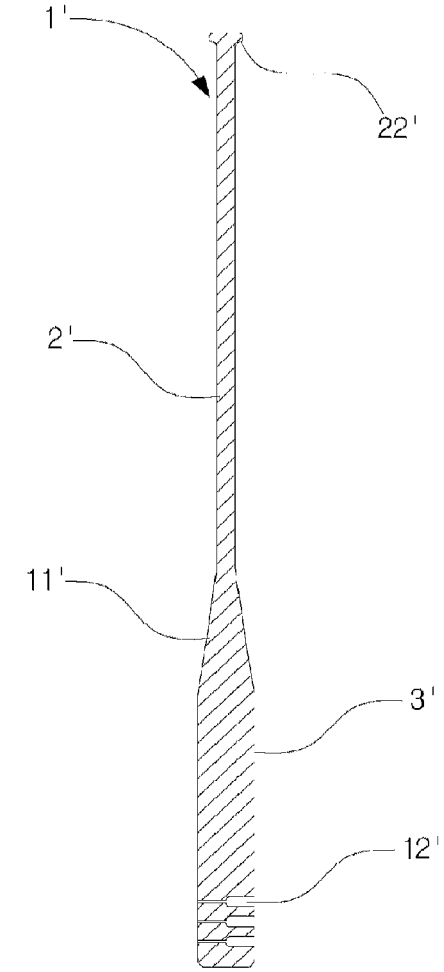
FIG. 7 is a schematic sectional view of a conventional golf practice bat.

The head portion 3, as shown in FIGS. 1-6, has a single or a plurality of through-holes 12 formed on its lower portion in the forward/backward horizontal direction at a predetermined upward/downward or leftward/rightward interval. The entrance portion of the through-hole 12, which is formed near the front surface of the head portion 3, has a large diameter, and the exit portion of the through-hole 12, which is formed near the rear surface of the head portion 3, has a diameter smaller than that of the entrance portion. Consequently, when the golf practice bat 1 is swung hard and fast at the time of impact, which requires the hardest and fastest swing, an airflow is instantly introduced through the wide entrance portion of the through-hole 12, which is formed near the front surface of the head portion 3 (corresponding to the club face of a conventional golf club), as shown in FIG. 6, and is discharged fast through the narrow exit portion. The resulting flute sound enables the user to estimate whether the correct square angle of the club face is maintained or not and whether the impact timing is correct or not during swing practices.

Most preferably, the entrance portion of the through-hole 12 has a diameter of about 0.8-1.5 cm, and the exit portion has a diameter of about 0.3-0.8 cm. If the entrance portion or the exit portion of the through-hole 12 has a diameter outside the above range, the flute sound is not properly generated even if the golf practice bat 1 is swung harder and faster.

If the entrance portion of the through-hole 12, which corresponds to the club face of a conventional golf club, does not maintain the square angle during an impact but deviates or slants during a swing, no airflow is properly introduced through the entrance portion of the through-hole 12, generating little or no flute sound, so that the user can recognize the incorrect swing posture. If the flute sound is heard before or after the impact position during a swing, the user can recognize that the impact timing is too early or late and then adjust the impact timing.

Figure 4:
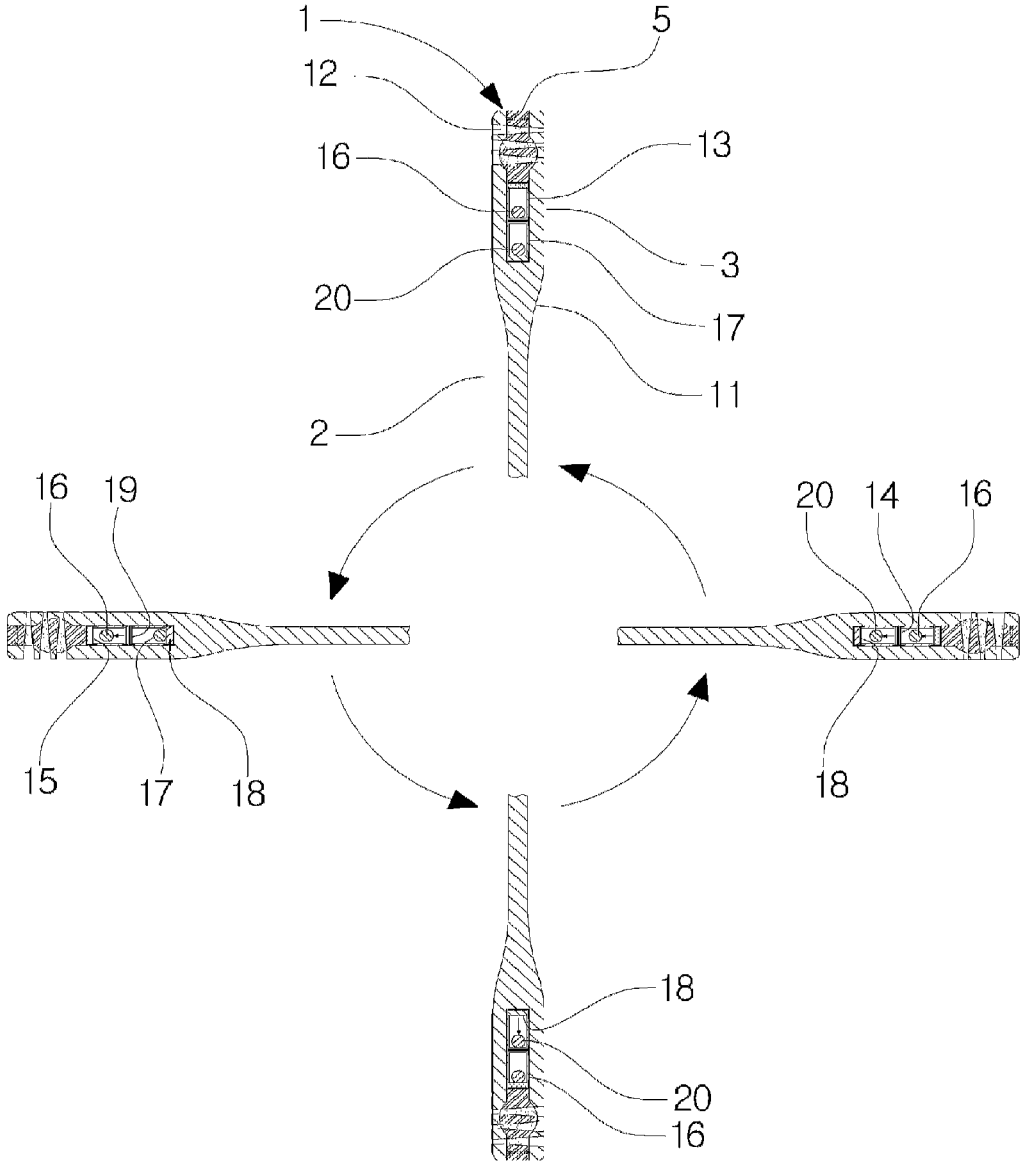
FIG. 4 is a schematic sectional view of a head portion illustrating the movement of first and second notice balls when a golf practice bat according to the present invention is swung from the top of a back swing to an impact and the time of finish of a follow swing.

The first notice tube 13 is, as shown in FIGS. 2-5, contained/installed on the inner middle portion of the head portion 3 in an upright position, and has a first notice ball 16 contained therein and adapted to enable the user to estimate the position and timing of the top and finish during back and follow swings. The first notice tube 13 has the shape of a tube with an outer diameter conforming to the inside of the insertion hole 7. The first notice tube 13 has a top metal plate 14 fixedly installed on its inner upper portion, a buffer material 15 fixedly installed on its lower portion, and a first notice ball 16 made of a metal material and movably contained therein. Consequently, when the head portion 3 is turned upside down, during back and follow swings, and reaches the top and finish positions, as shown in FIG. 4, the first notice ball 16 moves down due to its own weight, abuts the top metal plate 14, and generates a collision sound, enabling the user to estimate the position and timing of the top and finish of the club head.

The buffer material 15 is made of a material (e.g. sponge) that absorbs shocks and generates no collision sound and is adapted to prevent generation of a collision sound, prior to the time of impact during a down swing from the top position, as the first notice ball 16 moves downwards and hits the bottom surface of the first notice tube 13. Therefore, only the second notice ball 20 of the second notice tube 17 generates a collision sound at the time of impact, so that the user can accurately estimate the time of impact without any confusion.

The second notice tube 17 is, as shown in FIGS. 2-5, contained/installed upwards/downwards on the inner middle portion of the head portion 3 in an upright position together with the first notice tube 13, and has a second notice ball 20 contained therein to enable the user to estimate impact timing. The second notice tube 17 has the shape of a tube with an outer diameter conforming to the inside of the insertion hole 7. The second notice tube 17 has a magnet plate 18 made of a magnet material and fixedly installed on its inner upper portion, a bottom metal plate 19 fixedly installed on its lower portion, and a second notice ball 20 made of a metal material containing iron (Fe) and movably contained therein. Consequently, when the head portion 3 is turned upside down in the top position, as shown in FIG. 4, the second notice ball 20 abuts the magnet plate 18 and remains attached to it. The second notice ball 20 remains attached to the magnet plate 18 during a down swing and, when a predetermined rotational force is applied at the time of impact, the second notice ball 20 escapes from the magnet plate 18, abuts the bottom metal plate 19, and generates a collision sound, enabling the user to estimate the impact timing.

The second notice ball 20 is made of metal containing iron (Fe) and has a predetermined weight so that it remains attached to the magnet plate 18 by its magnetic force and, when a predetermined rotational force is applied at the time of impact during a down swing, escapes from the magnet plate 18. The weight of the second notice ball 20 can be varied in the following manner: in the case of a beginner or a female or elderly player, who has weak swing speed or force, a heavy second notice ball 20 is used so that it can easily escape from the magnet plate 18 even when a weak rotational force is applied; in the case of a male player, who has strong swing speed or force, a light second notice ball 20 is used so that it can escape from the magnet plate 18 only when a strong rotational force is applied.

The upper and lower portions of the first notice ball 13 and the second notice ball 17 are covered with finish caps 21*a*, 21*b*, 21*c*, 21*d*, respectively, to prevent the top metal plate 14, the buffer material 15, the magnet plate 18, and the bottom metal plate 19, which are fixedly installed on the upper and lower portions, respectively, from escaping or deforming due to shocks by the contained first notice ball 16 and the second notice ball 20. The upper metal plate 14 of the first notice tube 13 and the bottom metal plate 19 of the second notice tube 17 are made of a non-iron metal material and are not influenced by magnetic force from the magnet plate 18.

When the first notice tube 13 and the second notice tube 17 are stacked upwards/downwards as shown in FIG. 2, either the first notice tube 13 or the second notice tube 17 can be positioned above the other. If necessary, the first notice tube and the second notice tube 17 can also be juxtaposed leftwards/rightwards (not shown) inside the head portion 3.

The operation of the present invention will now be described.

When the golf practice bat 1 according to the present invention is used to practice golf swings (e.g. driver shots, iron shots), the upper end portion of the shaft 2 is grasped with both hands in the same manner as grasping a conventional golf club. The weight 5 made of a metal material and integrally contained/installed on the inner lower portion of the head portion 3 guarantees that the load is not distributed over the entire head portion 3, but is concentrated on the lower portion, a constant weight feeling is formed, muscles are strengthened in the course of golf swings, and a natural swing trajectory is formed. Consequently, when the head portion 3 is turned upside down, during a back swing, and reaches the top position, as shown in FIG. 4, the first notice ball 16 moves down due to its own weight, abuts the top metal plate 14, and generates a collision sound, enabling the user to estimate the top position and timing. The second notice ball 20 abuts the magnet plate 18 and remains attached to it in the top position and, when a predetermined rotational force is applied during a down swing, the second notice ball 20 escapes from the magnet plate 18, abuts the bottom metal plate 19, and generates a collision sound, enabling the user to estimate the impact timing. At this time, the first notice ball 20 hits the buffer material 15, before the time of impact, by means of rotational force and remains displaced downwards without generating any collision sound. When the head portion 3 is again turned upside down at the time of finish during a follow swing, the first notice ball 16 and the second notice ball 20, which are positioned on the upper side, move down due to their own weight. As a result, the first notice ball 16 attaches to the magnet plate 18 again, and the second notice ball 20 abuts the top metal plate 14 and generates a collision sound, informing the user of the finish position and timing. Therefore, the user can estimate each position and timing of the club head during swing practices throughput a back swing, an impact, and the time of finish of a follow swing.

The user also practices swings so that the entrance portion (corresponding to the club face of a conventional golf club) of the through-hole 12, which is bored on the lower portion of the head portion 3, maintains the correct square angle at the time of impact. Particularly, when the hardest and fastest swing is made at the time of impact, the airflow, which has been introduced instantly through the wide entrance portion of the through-hole 12, is discharged fast through the narrow exit portion, as shown in FIG. 6, generating a specific flute sound. Therefore, the user can recognize whether the club face maintains the correct square angle or not and whether the impact timing is correct or not, based on the flute sound as well as the collision sound made by the second notice ball 20, during swing practices.

The golf practice bat according to the present invention contains a weight made of a metal material so that the load is not distributed over the entire head portion, but is concentrated on the lower portion, a constant weight feeling is formed, muscles are strengthened in the course of golf swings, and a natural swing trajectory is formed. In addition, first and second notice tubes, which contain first and second notice balls, respectively, are installed on the inner middle portion of the head portion so that the user can estimate each position and timing during swing practices throughput the top of a back swing, an impact, and the time of finish of a follow swing. Therefore, the golf practice bat according to the present invention is widely applicable and useful in areas related to golf swing practice tools or products.

The invention claimed is:

1. A golf practice bat for adjusting top, impact, and finish timing, comprising:

a shaft of a stick shape having a diameter adapted to be grasped by hand;

a head portion (3) of a pillar shape having a diameter larger than the shaft, the head portion (3) being integrally formed on a lower portion of the shaft;

a weight (5) made of a metal material and integrally contained on an inner lower portion of the head portion (3) so that, while forming a predetermined weight feeling, a load is concentrated on a lower portion of the head portion (3);

a first notice tube (13) contained and installed in a upright position on an inner intermediate portion of the head portion (3), the first notice tube (13) having a top metal plate (14) fixedly installed on an inner upper portion, a buffer material (15) fixedly installed on a lower portion to prevent generation of a collision sound, and a first notice ball (16) movably contained inside the first notice tube (13) so that, when the head portion (3) is turned upside down and reaches top and finish positions during back and follow swings, the first notice ball (16) comes down to the top metal plate (14) and generates collision sounds enabling estimation of positions and timing of top and finish; and a second notice tube (17) contained and installed in a upright position on the inner intermediate portion of the head portion (3) together with the first notice tube (13), the second notice tube (17) having a magnet plate (18) fixedly installed on an inner upper portion, a bottom metal plate (19) fixedly installed on a lower portion, and a second notice ball (20) movably contained inside the second notice tube (17) so that the second notice ball (20) abuts and attaches to the magnet plate (18) in a top position and, when a predetermined rotational force is applied at a time of impact during a down swing, the second notice ball (20) escapes from the magnet plate (18), reaches the bottom metal plate (19), and generates a collision sound enabling estimation of impact timing.

2. The golf practice bat as claimed in claim 1, wherein the head portion (3) has a straight insertion hole (7) formed on the inner lower portion, the first notice tube (13) and the second notice tube (17) are inserted and interposed on an inner upper portion of the insertion hole (7), a concave portion (8) of a diameter larger than the insertion hole (7) is formed on an upper or middle portion of the insertion hole (7) positioned below the first notice tube (13) and the second notice tube (17), a weight (5) is integrally contained and installed on the inner lower portion of the head portion (3) by filling the insertion hole (7) and the concave portion (8) with melted metal and solidifying the metal so that the weight (5) has a protrusion (6) formed on an upper or middle portion to be convex outwards, a predetermined load is concentrated on the lower portion of the head portion (3), and the protrusion (6) prevents the contained weight (5) from escaping outwards during a swing.

3. The golf practice bat as claimed in claim 2, wherein a number of fixing pins (9) are fixedly installed at a predetermined interval on a lower inner peripheral surface of the insertion hole (7), and each fixing pin (9) has a portion protruding towards an inside of the insertion hole (7) so that, when an inner lower portion of the insertion hole (7) is filled with melted metal, the protruding portion of each fixing pin (9) remains integrally inserted into the melted metal and becomes integrated with the weight (5) formed through solidification of the melted metal.

4. The golf practice bat as claimed in claim 2, wherein a single or a plurality of through-holes (12) extend through the lower portion of the head portion (3) in a forward/backward horizontal direction at a predetermined upward/downward or leftward/rightward interval, an entrance portion of the through-hole (12) formed near a front surface of the head portion (3) has a large diameter, and an exit portion of the through-hole (12) formed near a rear surface of the head portion (3) has a diameter smaller than the diameter of the entrance portion.

5. The golf practice bat as claimed in claim 1, wherein a single or a plurality of through-holes (12) extend through the lower portion of the head portion (3) in a forward/backward horizontal direction at a predetermined upward/downward or leftward/rightward interval, an entrance portion of the through-hole (12) formed near a front surface of the head portion (3) has a large diameter, and an exit portion of the through-hole (12) formed near a rear surface of the head portion (3) has a diameter smaller than the diameter of the entrance portion.

6. The golf practice bat as claimed in claim 1, wherein the buffer material (15) is made of a sponge material that absorbs shocks and generates no collision sounds and is adapted to prevent generation of a collision sound when the first notice ball (16) moves downwards and hits a bottom surface of the first notice tube (13) before a time of impact during a down swing from the top position.

7. The golf practice bat as claimed in claim 1, wherein the first notice tube (13) and the second notice tube (17) are contained and installed on the inner intermediate portion of the head portion (3) while being stacked upwards/downwards or juxtaposed leftwards/rightwards.

8. The golf practice bat as claimed in claim 7, wherein upper and lower portions of the first notice tube (13) and the second notice tube (17) are covered with finish caps (21*a*)(21*b*)(21*c*)(21*d*), respectively, so that the top metal plate (14), the buffer material (15), the magnet plate (18), and the bottom metal plate (19), which are fixedly installed on the upper and lower portions, respectively, are prevented from escaping or deforming due to shocks from the contained first notice ball (16) and the second notice ball (20), and the second notice ball (20) is made of a metal material containing iron.

9. The golf practice bat as claimed in claim 1, wherein upper and lower portions of the first notice tube (13) and the second notice tube (17) are covered with finish caps (21*a*)(21*b*)(21*c*)(21*d*), respectively, so that the top metal plate (14), the buffer material (15), the magnet plate (18), and the bottom metal plate (19), which are fixedly installed on the upper and lower portions, respectively, are prevented from escaping or deforming due to shocks from the contained first notice ball (16) and the second notice ball (20), and the second notice ball (20) is made of a metal material containing iron.

10. The golf practice bat as claimed in claim 1, wherein the head portion (3) is adapted to prevent the contained weight (5) from playing and escaping by fixing and attaching a plug (10) to an entrance portion of the insertion hole (7) using a conventional adhesive after the inner lower portion of the insertion hole (7) is filled with melted metal and the metal is solidified.

* * * * *